United States Patent [19]

Grenier

[11] Patent Number: 4,717,410

[45] Date of Patent: Jan. 5, 1988

[54] PROCESS AND INSTALLATION FOR PRODUCING NITROGEN UNDER PRESSURE

[75] Inventor: Maurice Grenier, Paris, France

[73] Assignee: L'Air Liquide, Societe Anonyme pour l'Etude et l'Exploitation des Procedes Georges Claude, Paris, France

[21] Appl. No.: 837,049

[22] Filed: Mar. 6, 1986

[30] Foreign Application Priority Data

Mar. 11, 1985 [FR] France ..... 85 03515

[51] Int. Cl.[4] ..... F25J 3/02

[52] U.S. Cl. ..... 62/29; 62/39; 62/41

[58] Field of Search ..... 62/11, 18, 20, 38, 39, 62/29, 41

[56] References Cited

U.S. PATENT DOCUMENTS

| | | | |
|---|---|---|---|
| 3,267,684 | 8/1966 | Jakob | 62/29 |
| 3,416,323 | 12/1968 | Heinik | 62/18 |
| 3,760,596 | 9/1973 | Basin et al. | 62/41 X |
| 4,420,317 | 12/1983 | Stewart | 62/20 |
| 4,453,957 | 6/1984 | Pahade et al. | 62/29 X |
| 4,464,188 | 8/1984 | Agrawal et al. | 62/39 X |
| 4,556,404 | 12/1985 | Shenoy et al. | 62/20 X |

FOREIGN PATENT DOCUMENTS

| | | |
|---|---|---|
| 0153673 | 9/1985 | European Pat. Off. . |
| 827364 | 6/1952 | Fed. Rep. of Germany . |
| 1117616 | 11/1961 | Fed. Rep. of Germany . |
| 2402246 | 7/1975 | Fed. Rep. of Germany . |
| 1432850 | 2/1966 | France . |

*Primary Examiner*—Henry C. Yuen
*Assistant Examiner*—Steven E. Warner
*Attorney, Agent, or Firm*—Young & Thompson

[57] ABSTRACT

The rich liquid received at the base of the main column (3) at high pressure is expanded in two stages. After the first expansion to medium pressure, it is distilled so as to produce an addition of pure nitrogen. The second expansion achieves the reflux in the medium pressure column (4). Liquid nitrogen is pumped from this column to the high pressure column (3) and all the nitrogen can be produced at high pressure.

10 Claims, 2 Drawing Figures

N2
1
2
3
4
5
6
7
8
9
10
11
12
13
LN2

N2
1
2
3
4
5
6
7
8
9
10
11
12
14
15

PROCESS AND INSTALLATION FOR PRODUCING NITROGEN UNDER PRESSURE

FIELD OF THE INVENTION

The present invention relates to a process and an installation for producing nitrogen under pressure.

BACKGROUND OF THE INVENTION

In installations for producing nitrogen under pressure, the nitrogen is usually produced directly at the pressure of use, for example between 5 and 10 bars. Purified air, compressed slightly above this pressure, is distilled so as to produce the nitrogen at the top of the column and the reflux is achieved by expansion of the "rich liquid" (liquid at the base of the column formed by air enriched with oxygen) and cooling of the condenser at the top of the column by means of this expanded liquid. The rich liquid is thus vaporized at a pressure of between about 3 and 6 bars.

If the size of the installation justifies this, the vaporized rich liquid is passed through an expansion turbine so as to maintain the installation in the cold state but, often, this refrigerating production is excessive, which corresponds to a loss of energy. In the opposite hypothesis, the cold state is maintained by an addition of liquid nitrogen coming from an exterior source, and the vaporized rich liquid is simply expanded in a valve and then travels through the thermal exchange line serving to cool the initial air. Consequently, here again, a part of the energy of the vaporized rich liquid is lost.

OBJECT OF THE INVENTION

An object of the invention is to provide a process which supplies to the installation the exact amount of cold required for the thermal equilibrium while in all cases making use of the energy contained in the vaporized rich liquid and permitting the production of the whole of the nitrogen at the high pressure of the installation.

SUMMARY OF THE INVENTION

The invention therefore provides a process for producing nitrogen under a pressure termed high pressure, wherein air, compressed to a pressure about the high pressure and cooled to about its dew-point, is introduced at least partly at the base of a main distillation column operating at said high pressure; the rich liquid received at the base of said column is expanded to a medium pressure between the high pressure and atmospheric pressure, and introduced at an intermediate place of an auxiliary distillation column operating at said medium pressure; a top condenser of the main column is cooled by means of the liquid at the base of said auxiliary column; a part of said liquid is expanded to a low pressure so as to cool a top condenser of the auxiliary column; liquid is withdrawn at the top of the auxiliary column; said liquid is pumped up to the high pressure and injected at the top of the main column; and the nitrogen is withdrawn at the top of the main column.

The invention also provides an installation for producing nitrogen under pressure which carries out such a process. This installation comprises: a main distillation column including a top condenser and supplied at its base with compressed air at about the high pressure and cooled to about its dew-point; an auxiliary column comprising a top condenser operating at a medium pressure between the high pressure and atmospheric pressure; means for expanding to said medium pressure the liquid of the base of the main column and introducing said liquid, after expansion, at an intermediate place of the auxiliary column; means for supplying the top condenser of the main column with the liquid of the base of the auxiliary column so as to cool said top condenser; means for expanding a part of the liquid of the base of the auxiliary column and for supplying the top condenser of the auxiliary column with said expanded liquid so as to cool said top condenser of the auxiliary column; a conduit provided with a pump for withdrawing liquid at the top of the auxiliary column, for bringing said liquid to the high pressure and injecting the liquid thus compressed at the top of the main column; and means for withdrawing nitrogen from the top of the main column.

BRIEF DESCRIPTION OF THE DRAWINGS

Two examples of carrying out the invention will now be described with reference to the accompanying drawing, in which.

DETAILED DESCRIPTION OF THE INVENTION

Figure 1:
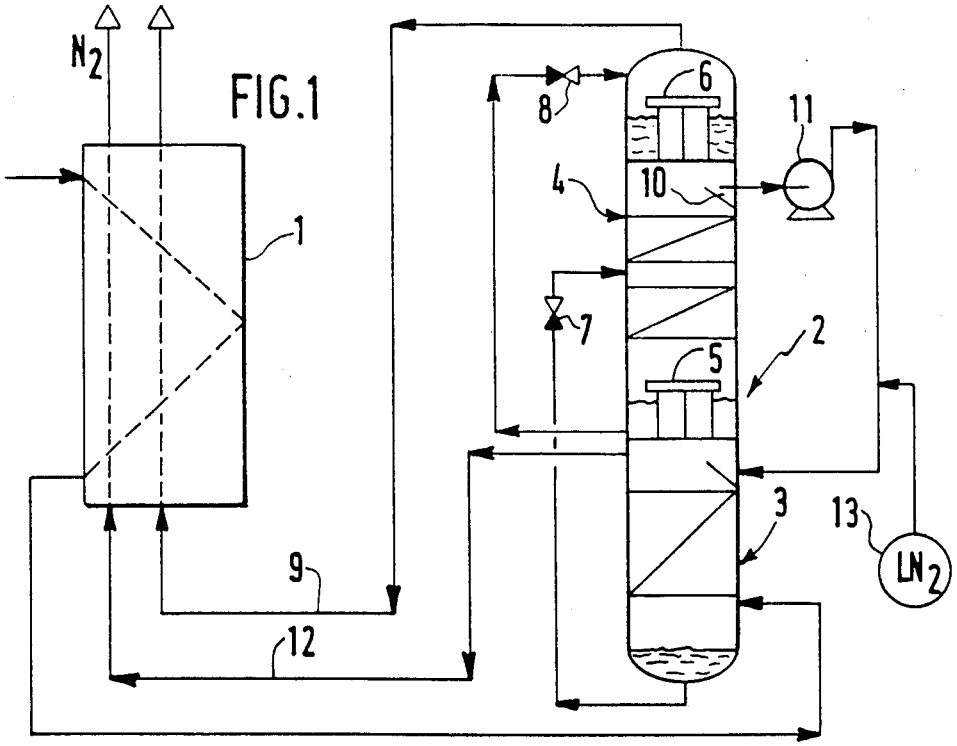
FIG. 1 is a diagrammatic view of an installation according to the invention without an expansion turbine.

The installation for producing pure nitrogen diagrammatically represented in FIG. 1 is an installation of relatively small size without an expansion turbine. It comprises a thermal exchange line 1 and a double distillation column 2. The latter is formed by a lower main column 3 operating at high pressure, i.e. at the production pressure, on the order of 8 to 10 bars, and an upper auxiliary column 4 for operating at a medium pressure, on the order of 4 to 5 bars. Each of these columns has a top condenser 5,6 respectively.

Purified air, compressed to a pressure slightly higher than the high pressure, is cooled to about its dewpoint through the exchange line 1 and introduced at the base of the column 3. The rich liquid in equilibrium with this air, received at the base of the column 3, is expanded to the medium pressure in an expansion valve 7 and introduced at an intermediate point of column 4. In the latter, the descending liquid is enriched in oxygen and cools the main condenser 5 at the base of the column so as to ensure the reflux in the column 3. A part of the same liquid is again expanded to a pressure slightly higher than atmospheric pressure in an expansion valve 8 and then serves to cool the auxiliary condenser 6 and ensure the reflux in the column 4. The same liquid, after vaporization, is sent in countercurrent manner by a conduit 9 through the exchange line 1 so as to constitute the residual gas of the installation.

The vapor which rises in the column 4 is progressively enriched in nitrogen, and it is pure nitrogen which is condensed by the upper condenser 6. A fraction of the condensed flow is received in a drain 10, withdrawn from the column 4 and brought back by a pump 11 to the high pressure and reinjected at the top of the column 3. The gaseous nitrogen is withdrawn at the top of the latter and sent in a countercurrent manner by a conduit 12 through the exchange line 1 for the purpose of its utilization.

The installation is maintained cold by an additional supply of liquid nitrogen under high pressure coming from an exterior source 13, this liquid nitrogen being introduced at the top of the column 3. The energy contained in the rich liquid under high pressure is used not only for achieving the distillation in this column 3, as is conventional, but also for distilling this liquid in the column 4 and thus increasing the production of nitrogen by means of the quantity withdrawn at the top of the column 4.

Figure 2:
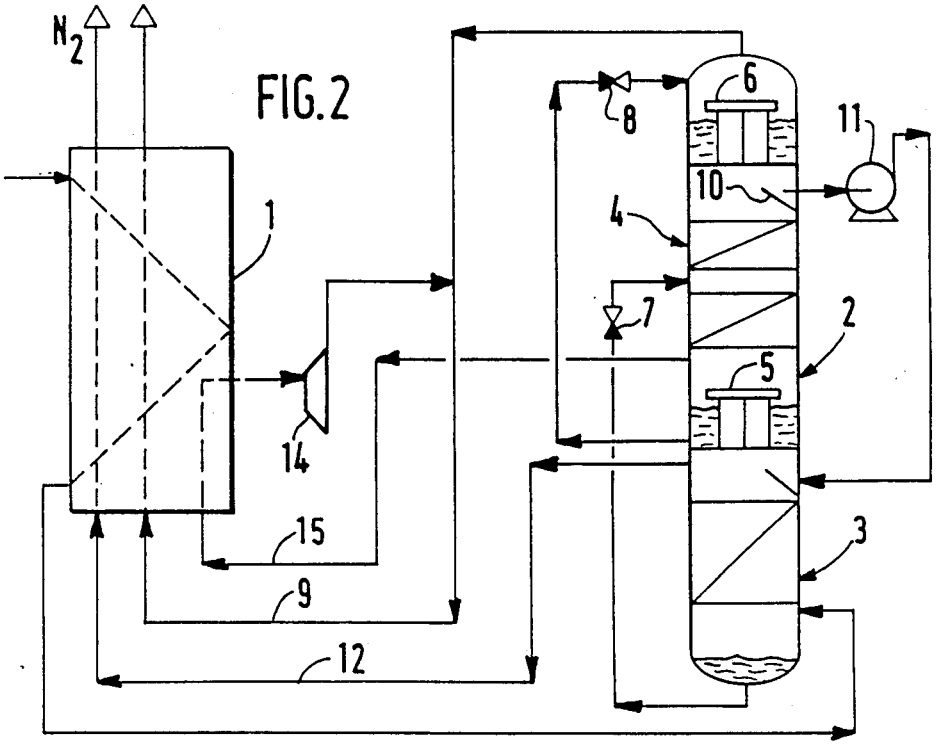
FIG. 2 is a diagrammatic view of an installation according to the invention with an expansion turbine.

The installation shown in FIG. 2 differs from that shown in FIG. 1 only in respect of the manner in which the addition of cold is achieved. It concerns an installation of large size equipped with an expansion turbine 14, the exterior source of liquid nitrogen 13 of FIG. 1 being eliminated. Gas is withdrawn in the lower part of the column 4 and sent by a conduit 15 in countercurrent manner through the exchange line 1 up to the suitable temperature level, then issues from this exchange line, is expanded in the turbine 14 and injected into the conduit 9 at low pressure upstream of the exchange line.

It can be seen that with such an arrangement, the turbined flow can be adjusted to the value just necessary for achieving the thermal equilibrium, independently of the high pressure. Of course, the higher the turbined flow, the less one can withdraw liquid nitrogen from the top of the column 4, for a given purity of the nitrogen. Further, if it not desired to produce nitrogen of high purity, the rate of flow withdrawn at the top of the column 4 can be increased.

What is claimed is:

1. A process for producing nitrogen under a pressure termed high pressure, comprising compressing air and cooling said air to substantially the dew-point thereof, introducing at least a part of said air at a base of a main distillation column operating at said high pressure; receiving a rich liquid at the base of said column and expanding said rich liquid to a medium pressure between said high pressure and atmospheric pressure and introducing the rich liquid at an intermediate place of an auxiliary distillation column operating at said medium pressure; cooling a top condenser of the main column by means of the liquid of the base of the auxiliary column; expanding a part of the last-named liquid to a low pressure so as to cool a top condenser of the auxiliary column; withdrawing liquid from the top of the auxiliary column, pumping said withdrawn liquid up to said high pressure and injecting it at the top of the main column; and withdrawing product nitrogen from the top of the main column.

2. A process according to claim 1, comprising expanding gas taken from the auxiliary column in a turbine so as to produce cold.

3. A process according to claim 1, in which said air is of substantially said high pressure during said cooling thereof.

4. A process according to claim 1, in which said product nitrogen is withdrawn from the top of the main column in gaseous phase.

5. A process according to claim 1, comprising introducing an addition of liquid nitrogen from an exterior source in the main column.

6. A process according to claim 5, comprising expanding gas taken from the auxiliary column in a turbine so as to produce cold.

7. An installation for producing nitrogen under a pressure termed high pressure, comprising: a main distillation column including a top condenser and means for supplying compressed air at substantially said high pressure to the base of the main column and means for cooling said compressed air to substantially the dew-point thereof; an auxiliary column including a top condenser and operating at a medium pressure between said high pressure and atmospheric pressure; means for expanding to said medium pressure the liquid of the base of the main column and introducing said expanded liquid at an intermediate place of the auxiliary column; means for supplying the top condenser of the main column with the liquid of the base of the auxiliary column so as to cool said top condenser; means for expanding a part of the liquid of the base of the auxiliary column and for supplying the last-named expanded liquid to the top condenser of the auxiliary column so as to cool said top condenser of the auxiliary column; a conduit provided with a pump for withdrawing liquid from the top of the auxiliary column, bringing said liquid to said high pressure and injecting the compressed liquid at the top of the main column; and means for withdrawing product nitrogen from the top of the main column.

8. An installation according to claim 7, comprising a refrigeration-producing turbine connected to the auxiliary column for receiving gas from the auxiliary column.

9. An installation according to claim 7, comprising an exterior source of liquid nitrogen connected to the top of the main column.

10. An installation according to claim 9, comprising a refrigeration-producing turbine connected to the auxiliary column for receiving gas from the auxiliary column.

* * * * *